US005273209A

United States Patent [19]

MacArthur et al.

[11] Patent Number: 5,273,209

[45] Date of Patent: Dec. 28, 1993

[54] HEAT EXCHANGE AND FUEL FEED APPARATUS FOR VERTICAL FURNACE

[76] Inventors: Charles E. MacArthur, 5 High St., Sangerville, Me. 04479; Charles A. Malatesta, R.F.D. 2, Box 2250, Dexter, Me. 04930

[21] Appl. No.: 854,724

[22] Filed: Mar. 23, 1992

[51] Int. Cl.[5] ..... F24H 3/06

[52] U.S. Cl. ..... 237/18; 126/101; 126/362; 110/234; 110/110

[58] Field of Search ..... 237/19, 8; 126/132, 126/101, 391, 501, 362; 110/234, 110, 226

[56] References Cited

U.S. PATENT DOCUMENTS

| | | | |
|---|---|---|---|
| 2,148,351 | 2/1939 | Hallsten | 237/19 |
| 2,577,659 | 12/1951 | Knipping | 110/226 |
| 3,716,339 | 2/1973 | Shigaki et al. | 110/226 |
| 4,178,907 | 12/1979 | Sweet, Jr. | 237/19 X |
| 4,462,542 | 7/1984 | Person | 237/19 |
| 4,836,115 | 6/1989 | MacArthur | 110/234 |

*Primary Examiner*—Henry A. Bennett

*Attorney, Agent, or Firm*—Notaro & Michalos

[57] ABSTRACT

A heating unit and solid fuel feeder comprises a vertical furnace having a combustion chamber for burning solid fuel, a water jacket around the combustion chamber and an exhaust chamber at an upper outlet end of the combustion chamber. A plenum box is connected to the furnace and defines an interior space. Water circulation tubes extend from an upper end of the water jacket, through the plenum and into a water tank positioned on an opposite side of the plenum. Additional water tubes are connected between a lower end of the water tank and a lower end of the jacket. Water circulates as hot water rises in the jacket and falls in the water tank. A plurality of exhaust conduits which also extend in the plenum, are connected between the exhaust chamber and a smoke box. A stack is connected to the exhaust box. Air flowing or blown through the plenum picks up heat from the water pipes and exhaust conduit. Hot water from the tank may be used as an additional source of heat or to heat domestic hot water.

15 Claims, 4 Drawing Sheets

FIG. 1
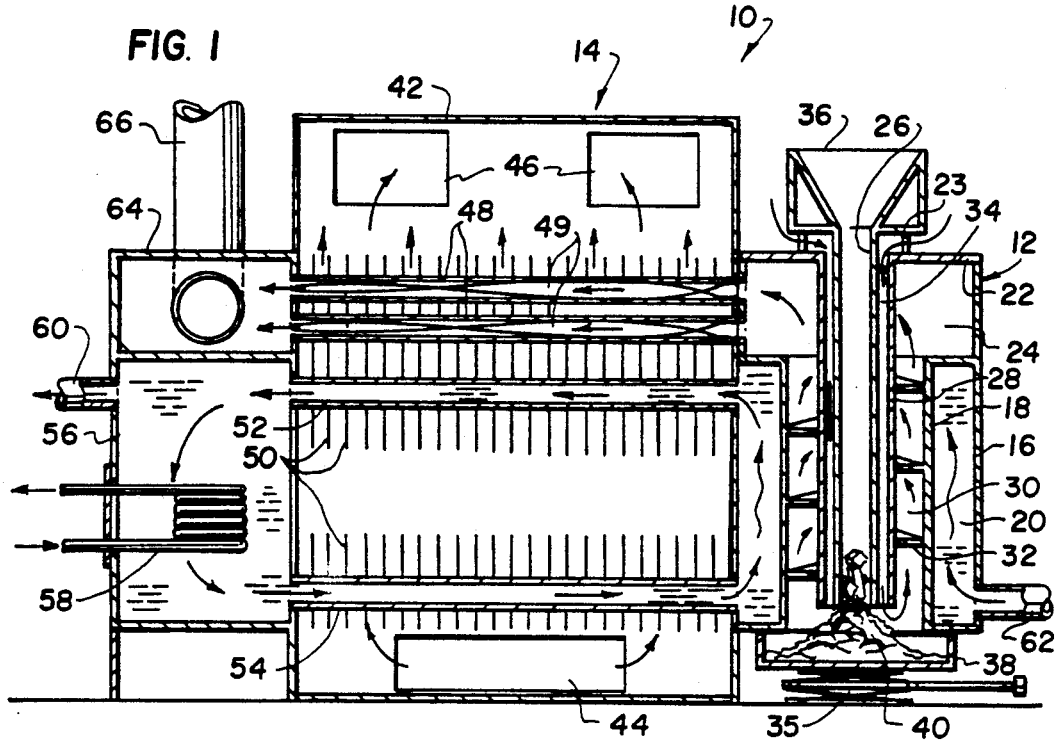
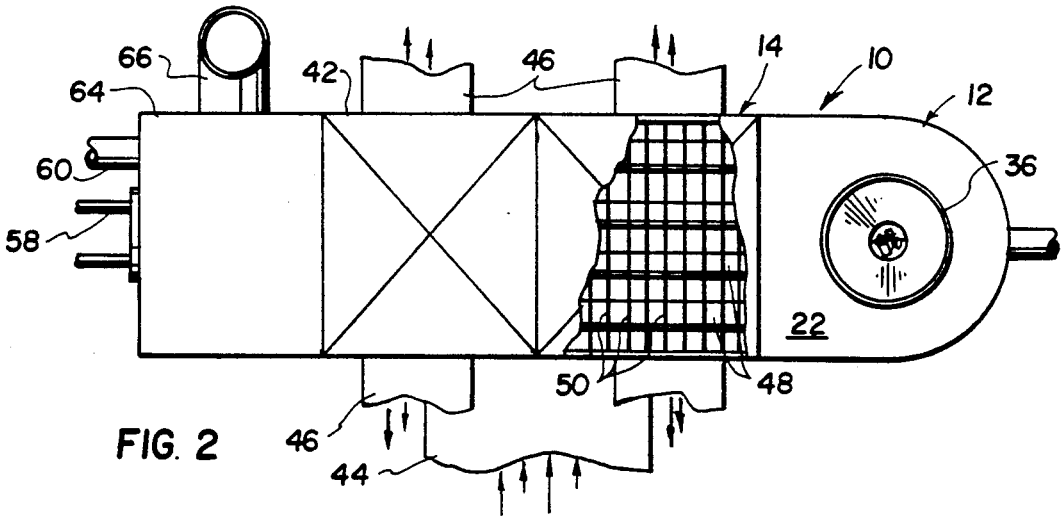
FIG. 2

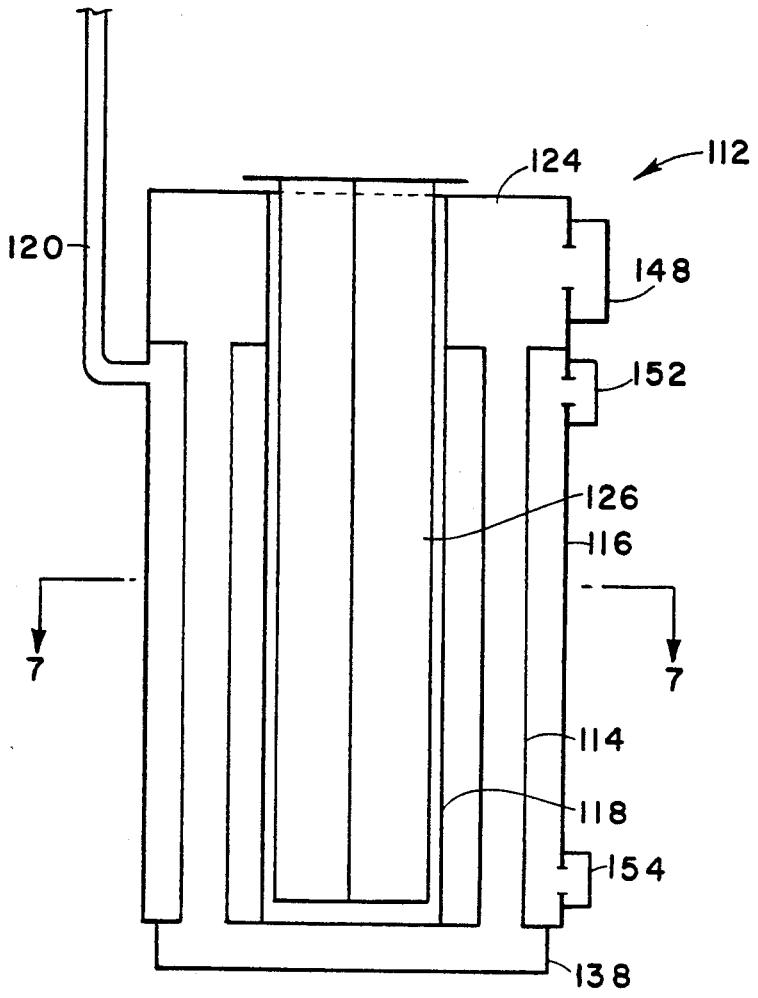
FIG. 6
FIG. 7
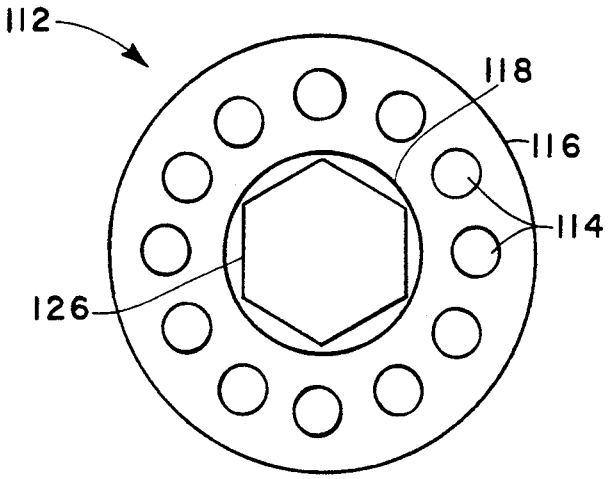

HEAT EXCHANGE AND FUEL FEED APPARATUS FOR VERTICAL FURNACE

FIELD AND BACKGROUND OF THE INVENTION

The present invention relates in general to heat exchangers, and in particular to a heat exchanger and fuel feed apparatus for use in combination with a furnace, in particular a vertical furnace of the type disclosed in U.S. Pat. No. 4,836,115.

U.S. Pat. No. 4,836,115 issued to one of the co-inventors of the present application, discloses a vertically oriented furnace which burns bio-mass at very high temperatures and efficiency. Tests conducted with the vertical furnace have shown efficiencies as high as 86.6% with temperatures inside the furnace reaching up to 2000° F. (1093° C.). As a result of the high temperature and efficient operation of the vertical furnace, the furnace burns virtually smoke-free. This is true even if the furnace is used as an incinerator for household and other waste.

One particularly effective fuel for the vertical furnace is wood chunks. Other fuels which have been tested and burn at high efficiencies and little or no smoke include tire chips, wet diapers and other household trash, and waste from restaurants. Despite the many advantages of the vertical furnace disclosed in U.S. Pat. No. 4,836,115, two limitations exist which are addressed by the present invention.

The first of these is the need for a highly efficient and well engineered heat exchanger assembly for removing heat from the high temperature vertical furnace at a rate which matches the high heat and high efficiency of the furnace. The second is the need for continuously stoking the furnace when it is operated at maximum burning rate and capacity.

SUMMARY OF THE INVENTION

One object of the present invention is to provide a heat exchanger assembly which is specifically constructed to service a high efficiency vertical furnace. To this end, the heat exchanger assembly includes both liquid and gas circulation to remove a maximum amount of heat from the furnace in the simplest possible manner.

A further object of the present invention is to provide a fuel feeding apparatus which is capable of slowly metering solid fuel to the furnace in a well controlled manner. Accordingly, the present invention provides a heating unit comprising: a furnace having a combustion chamber for burning solid fuel, a water jacket around said combustion chamber for receiving water to be heated by the burning of solid fuel in the combustion chamber, and an exhaust chamber at an upper outlet end of said combustion chamber, for receiving hot exhaust gases from said combustion chamber; means defining a hot air plenum connected to said furnace; water circulation means connected to said water jacket extending into a lower portion of said plenum for circulating heated water from said jacket to said plenum and then back to said jacket, to heat air in the lower portion of said plenum; at least one exhaust conduit connected to said exhaust chamber and extending through an upper portion of said plenum for passing hot exhaust gases from said exhaust chamber to heat air in the upper portion of said plenum; and means for circulating heating air through said plenum.

The invention also provides a solid fuel feeder apparatus in the form of a slowly rotating drum which is at least partly filled with solid fuel and which is inclined downwardly to an outlet end of the drum which discharges solid fuel into a vertical feed tube in the furnace.

Another object of the present invention is to provide a heater with vertical furnace, heat exchanger and a solid fuel feeding apparatus for the vertical furnace which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

BRIEF DESCRIPTION OF THE DRAWINGS

In the drawings:

FIG. 1 is a side sectional view of the heating unit of the present invention including a vertical furnace and a heat exchanger assembly;

FIG. 2 is a top plan view of the apparatus shown in FIG. 1, with a portion broken away to reveal underlying structure;

FIG. 6 is a schematic vertical sectional view, partly in elevational, of an alternate embodiment of the furnace; and FIG. 7 is a transverse sectional view taken along line 7—7 in FIG. 6.

DESCRIPTION OF THE PREFERRED EMBODIMENTS

Figure 3:
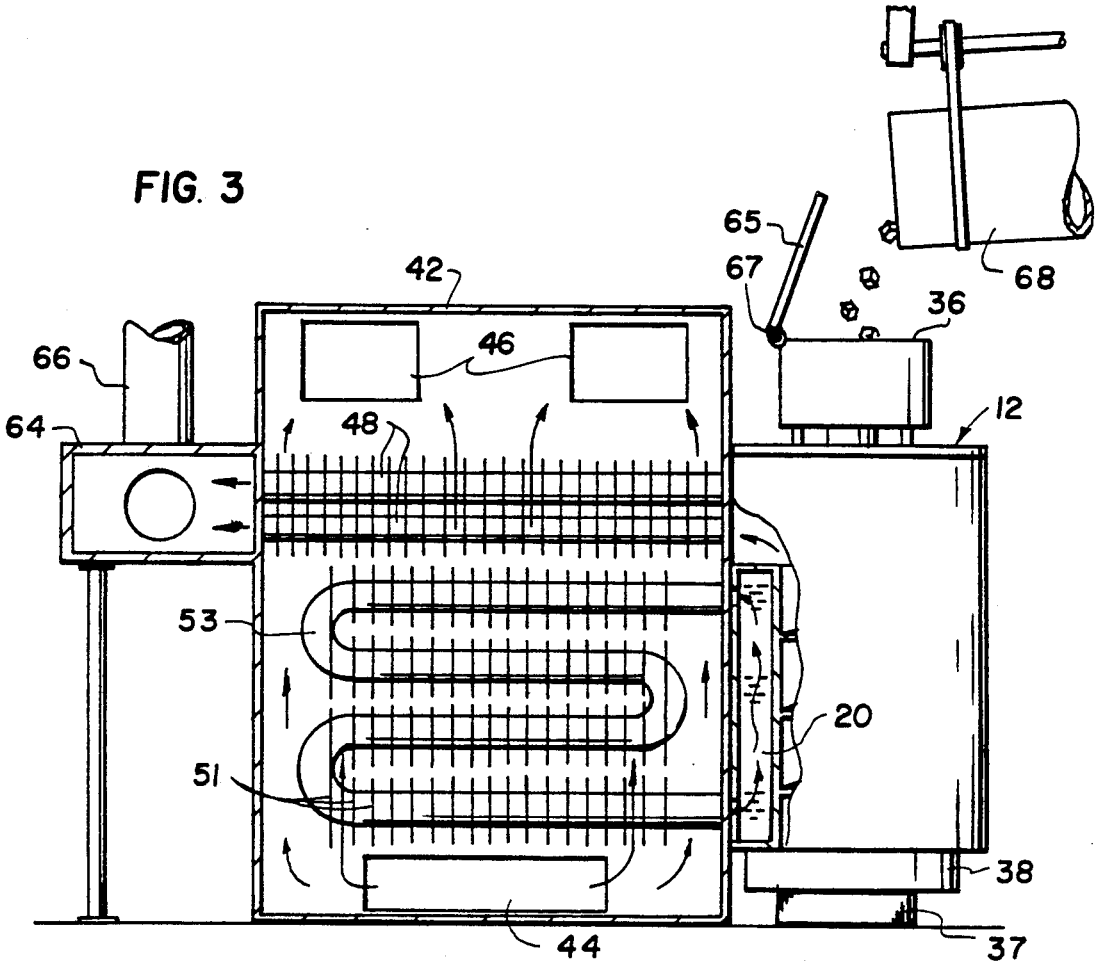
FIG. 3 is a view similar to FIG. 1 illustrating a second embodiment of the heating unit according to the invention.

Referring to the drawings in particular, the invention embodied in FIGS. 1 and 2 comprises a heating unit generally designated 10 which can be used for domestic or commercial space and water heating.

The unit includes a vertical furnace generally designated 12 of the type disclosed in U.S. Pat. No. 4,836,115 which is incorporated here by reference.

A heat exchanger assembly generally designated 14 is connected to the furnace 12 for heating air and water.

Furnace 12 comprises an outer wall 16 which, as shown in FIG. 2, is semi-cylindrical at its outer end facing away from the heat exchanger assembly 14, and rectangular where the outer wall meets the heat exchanger assembly. A cylindrical inner jacket wall 18 is positioned concentrically within the outer wall 16 and has top and bottom walls welded to the outer wall to form an annular water jacket 20.

An upper extension of outer wall 16 forms the sides of an exhaust chamber 24 whose upper end is closed by a cover 22 which is welded to the upper end of an inner combustion chamber wall 28. An annular combustion chamber 30 is defined between inner jacket wall 18 and inner combustion chamber wall 28. A spiral baffle 32 forms a helical combustion passage in chamber 30 from a lower ash cone or crucible 40 (where most of the combustion in the furnace takes place), upwardly to the exhaust chamber 24. Baffle 32 is optional, however, and need not be included. Solid, preferably bio-mass fuel such as wood chunks, trash and the like is fed to crucible 40 through a funnel shaped fuel inlet 36 to a vertical fuel feed tube 26 which is concentrically positioned inside inner combustion chamber wall 28. Instead of the funnel shaped fuel inlet 36, the fuel inlet may be a cylindrical upward extension of the fuel feed tube 26 to avoid bridging of fuel which tends to jam the fuel and preclude its dropping smoothly to the feed tube 26. An annular inlet air chamber 34 is defined between tube 26 and wall 28. Suction caused by the consumption of oxygen in crucible 40 and the upwardly spiralling hot exhaust gases in combustion chamber 30, draw cool denser combustion air into the inlet chamber 34 and downwardly around the outer surface of tube 26, to the crucible 40. This has the double purpose of cooling the tube 26 for preventing preignition of the fuel in the tube, and of supplying preheated combustion air to the combustion chamber.

The lower end of combustion chamber 30 is closed by an ash pan 38 which contains the ash cone 40. Lifting means in the form of a jack or other appropriate device 35 is used to lift the ash pan into sealing engagement with the bottom surface of water jacket 20 to close the combustion chamber. To remove ash from the furnace, jack 35 is lowered and pan 38 is pulled from under the furnace. Resilient refractory material such as KAOWOOL brand fiber is used to seal the upper edge of pan 38 against the lower surface of jacket 20. KAOWOOL is a trademark of the Babcock & Wilcox Co.

For ease of construction, similar resilient refractory material is used to seal the upper edge of outer wall 16 against the lower outer periphery of cover 22. For convenient disassembly of the furnace, fuel inlet 36 which is welded to tube 26 and spaced from the cover 22 by a plurality of feet 23 can be lifted from the furnace. Thereafter, cover 22 with the inner combustion chamber wall 28 welded thereto, can be lifted from the top of the furnace. The baffle 32 which is welded to the inner surface of inner wall 18, and serves to center the inner wall 28, is then exposed along with the combustion chamber for inspection and maintenance.

Heat exchanger assembly 14 comprises a hot air plenum box 42 which is made of sheet metal.

One or more sheet metal ducts or conduits 44 are connected to the lower end of plenum box 42 to supply cold air. The cold air rises in the plenum, picks up heat in a manner which will be described later, and exits through one or more outlet ducts or conduits 46. The hot air can be used to heat spaces where needed.

In order to heat the air in plenum 42, preferably eight or more exhaust pipes or conduits 48 are connected to the exhaust gas chamber 24 for passing hot exhaust gases through an upper portion of the plenum, to a smoke box 64 to which a smoke stack 66 is connected for discharging the virtually smoke free and non-polluting exhaust from the vertical furnace 12.

The inventors have found that heat transfer from the exhaust conduits 48 to the air in plenum 42 is greatly enhanced by including helical ribbons or "turbulators" 49 inside each tube 48. This causes the exhaust gases to spiral as they pass through the tubes 48, increasing the heating of the tubes.

To draw heat from the water in water jacket 20, a plurality of upper water tubes 52 (preferably four or more) are connected between an upper end of water jacket 20 and a small water storage tank 56. Water from tank 56 is returned to the lower end of jacket 20 through a plurality of lower return pipes 54.

Circulation between jacket 20 and tank 56 is by gravity feed or "thermosyphon". As the water in jacket 20 is heated, it tends to rise and cause the water to flow through pipes 52 to tank 56. In tank 56, the water tends to cool, driving the water back through return pipes 54.

Sheet metal heat transfer fins 50 are provided around all of the pipes 48, 52 and 54 in plenum 42, to further increase heat transfer from the hot gases and water to the air within the plenum. Although here again, natural circulation will produce a draft of air in through duct 44, up through the plenum and out through ducts 46, a blower or other forced air system is advantageously utilized to maximize the heat transfer effect.

Because of the high efficiency and high temperature operation of furnace 12, small water tank 56 may be insufficient to remove all the heat which must be removed from the furnace. For this reason, an additional outlet pipe 60 is provided near the top of tank 56, for communication with a large hot water storage tank (not shown). A return pipe 62 from the large storage tank is connected to the bottom of jacket 20, to return the now cooler water. Again, natural circulation is utilized. At any area of the water circulation system however, an in-line pump or other active circulator may be utilized.

For domestic use, a conventional tank-less hot water coil 58 is positioned within tank 56 and connected to a domestic hot water heater (not shown) which may be of the gas or electric type. This provides another avenue for full utilization of the generated heat and reduces the cost of operating the water heater which now contains hotter water to start with.

Figure 4:
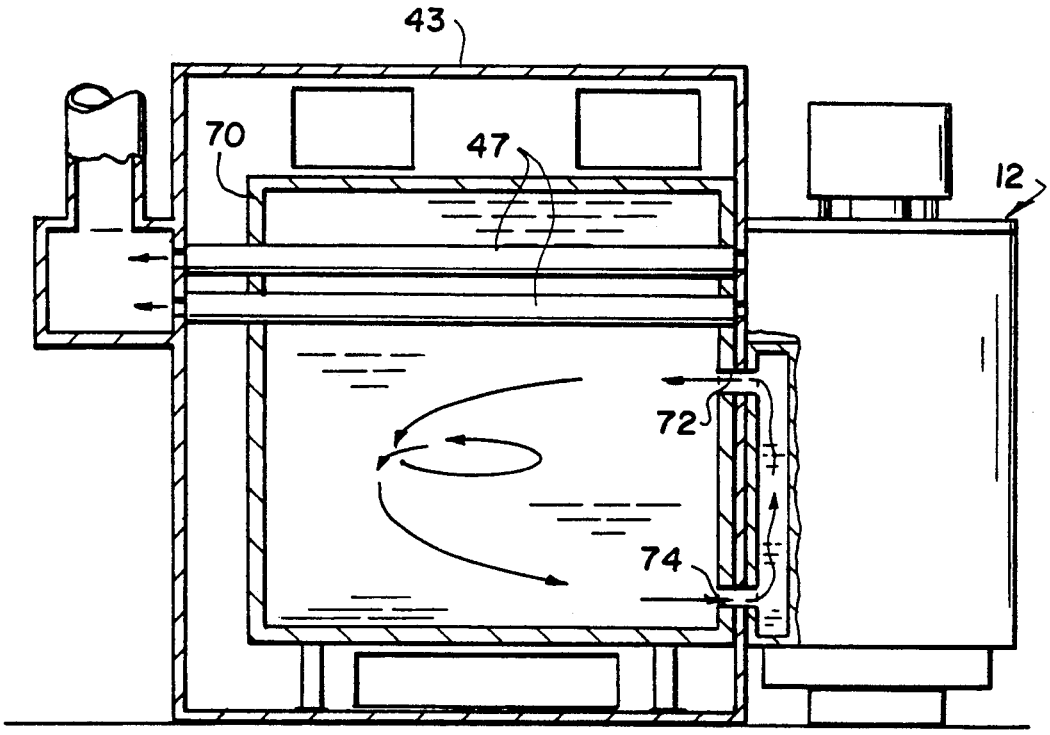
FIG. 4 is a view similar to FIG. 1 showing a third embodiment of the invention.

In FIGS. 3 and 4, two alternate embodiments of the invention are disclosed where the same reference numerals are utilized to designate the same or functionally similar parts.

The embodiment of FIG. 3 differs from the embodiment of FIG. 1 in that it does not include a small water tank. Instead, serpentine pipes 53 have an inlet connected to the upper end of jacket 20 and an outlet connected to the lower end of jacket 20, and extend through the lower portion of plenum box 42. Fins 51 are also provided which may be connected to or separate from fins on the exhaust pipes 48 in the upper portion of the plenum. FIG. 3 also shows the use of a simple block 37 under ash pan 38 to act as the lifting means for the pan by wedging to block under the pan. Four or more pipes 53 may be used one behind the other across the width of plenum 42.

At the upper end of furnace 12, a drum 68 is also illustrated which, as will be explained later in connection with FIG. 5, forms part of a fuel feeding apparatus of the invention. A lid 65 is also shown connected at a hinge 67 to the fuel inlet 36. The lid is used as an auxiliary safety mechanism in case the fuel inlet 36 becomes overheated. In this event, hinge 67 which may incorporate a heat meltable element or be "frozen open" by a coating of heat meltable material, drops the lid 65 over the inlet 36, precluding the supply of any additional fuel and confining the heat to the interior of the furnace. A suitable low melting material is solder. In practice, however, the inventors have found there is little or no danger of flames or excessive heat in the fuel inlet 36 or even in the upper end of the fuel tube 26.

FIG. 4 shows a still further embodiment of the invention where furnace 12 is connected to a large (advantageously 275 gallon) water storage tank 70 having an inlet 72 from the upper end of jacket 20 and an outlet 74 connected to the lower end of the jacket. Natural circulation of the rising water in jacket 20 eventually heats all of the water in the tanks 70 to a uniform high temperature. Exhaust pipes 47 connected between the exhaust chamber of the furnace 12 and the smoke box 64 also extends through the upper interior of tank 70 and thus through a plenum box. Tank 70 is positioned within a plenum box 43.

Plenum box 43 has a lower inlet and one or more upper outlets for circulating air to be heated around tank 70.

Figure 5:
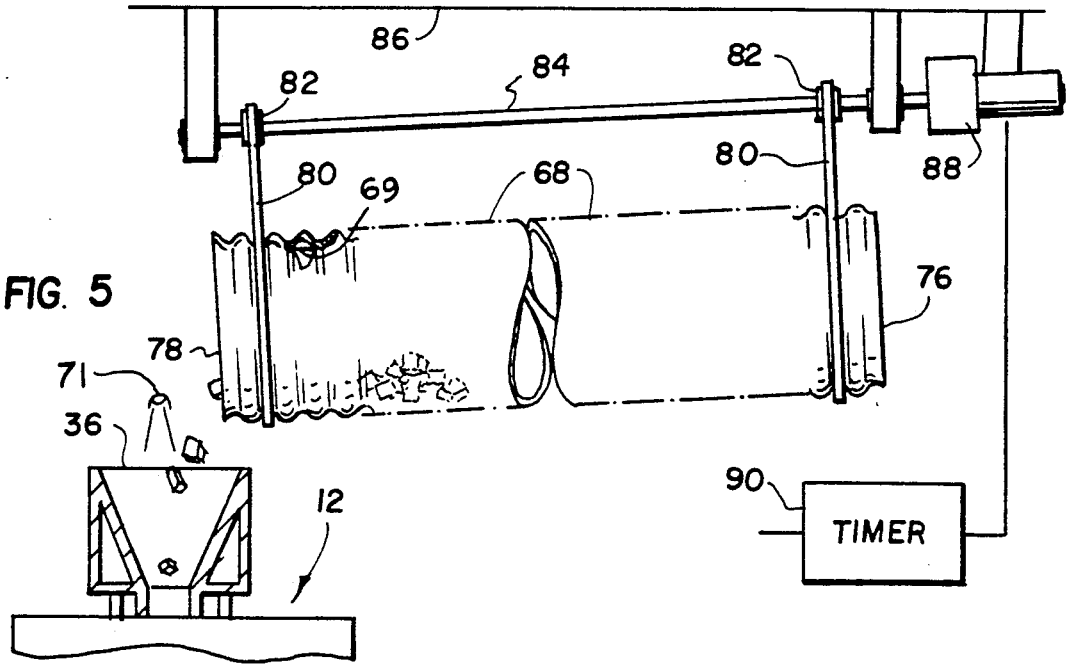
FIG. 5 is a side elevational view illustrating the solid fuel feeding apparatus of the present invention.

FIG. 5 illustrates a fuel feeding apparatus of the present invention which comprises a large diameter drum 68 having an open inlet end 76 and an open outlet end 78. Outlet end 78 is positioned just over the fuel inlet 36. Solid fuel such as wood chunks is shoveled into the inlet end 76 and lies in a pile which eventually extends along the length of the drum 68. Drum 68 is inclined downwardly from its inlet to its outlet end at a very gentle slope of 1° to 10°, and preferably 2° to 4°. This gentle slope causes the solid fuel to slowly migrate along the length of the drum and eventually drop off into the inlet 36. In one embodiment of the invention, the drum is nine feet long and has a diameter of 16 to 18 inches. The inventors have found that standard PVC sewer piping with a smooth cylindrical inner surface 69, can be utilized as drum 68. This material is conveniently corrugated on its outer surface and provides ample sites for a pair of V-belts 80 which engage around the drum near opposite ends thereof, and around a pair of pulleys 82 on a shaft 84 rotatably mounted on bearings connected to an overlying support 86, such as the ceiling. Shaft 84 is advantageously at the same inclined angle as drum 68 and is slowly rotated at approximately ½ a revolution per minute, by a motor and gear box combination 88 which is connected to the end of the shaft and to support 86. Motor means 88 is operated by a timer 90 and runs for example for 10 seconds every five minutes.

The timer may also be connected to temperature sensors anywhere in the furnace or heat exchanger assembly which disconnects all power to the motor means 88 if too great a temperature is sensed. Other sensors may also be provided in and around the furnace to control the rotation of drum 68. For example, an ultrasonic or ranging electric eye 71 can be positioned above the fuel inlet 36 for sensing the level of fuel within the fuel feed tube, to maintain a proper fuel level by starting and stopping motor 88. Alternatively, a differential pressure switch (not shown) can be provided for measuring stack versus hearth pressures and controlling fuel feed in this way.

Referring now to FIGS. 6 and 7, an alternate furnace generally designed 112 may be used in conjunction with the heaters disclosed in FIGS. 1-5, or independently for any other purpose as a source of hot air and/or hot water or steam as required. Furnace 112 comprises an outer wall 116 which is cylindrical and surrounds an inner wall 118 to define a water jacket therebetween. Hot water or steam leaves the water jacket through an outlet 152 and returns to the jacket as cold water or condensate through an inlet 154. A plurality of vertically extending fire tubes 114 are positioned within the water jacket and communicate a lower combustion space defined inside an ash pan 138, with an upper hot air plenum or exhaust gas chamber 124. As with the burner 12, burner 112 includes an inner fuel feed tube 126 which, rather than being cylindrical, is hexagonal as best shown in FIG. 7. Feed tube 126 is spaced inwardly from the cylindrical inner wall 118 and defines an air inlet space for receiving air from above the furnace, down into the combustion space. A vent 120 communicating with the top of the water jacket may also be provided for accommodating expansion of water or steam in the jacket. An exhaust output 148 communicates with the exhaust chamber 124 and can supply hot gases through the heaters shown in FIGS. 1-5 or vent hot gases from the exhaust chamber directly to a stack.

The primary different between furnace 12 and furnace 112, is the fact that exhaust gases, rather than travelling upwardly in the vicinity around the air inlet conduit, are fully in the water jacket, exposing more heat exchange surface to the water in the jacket and reducing the chances of corrosion.

The hexagonal fuel feed tube has also been found to feed chunk and granulated fuel more efficiently, and further mounting the hexagonal tube within a cylindrical inner jacket 118, defines six somewhat separated upwardly extending inlet air passages, to better collimate the inlet gas.

Where fist size fuel chunks are to be used, it is also possible to eliminate the fuel feed tube 126 and supply fuel directly through the inner jacket wall 118. All air is supplied through the same conduit. This has the advantage of backing up all fire contacting metal with water which will extend the life of all parts of the furnace. The hexagonal feed tube 126 may also be pentagonal or any other polygonal shape and is best used for supplying wood chips and other finer fuels. A single furnace can be used both without the inner feed tube (for coarse fuel) and with the tube (for fine fuel) when different fuels must be burned.

While specific embodiments of the invention have been shown and described in detail to illustrate the application of the principles of the invention, it will be understood that the invention may be embodied otherwise without departing from such principles.

What is claimed is:

1. A heating unit comprising:

a furnace having a combustion chamber for burning solid fuel, a water jacket around said combustion chamber for receiving water to be heated by the burning of solid fuel in the combustion chamber, and an exhaust chamber at an upper outlet end of said combustion chamber, for receiving hot exhaust gases from said combustion chamber, said furnace comprising an outer wall surrounding said water jacket, an inner jacket wall connected to said outer wall and defining said water jacket with said outer wall, an inner combustion chamber wall spaced inwardly from said inner jacket wall and defining said combustion chamber which is annular and around said inner walls, and a feed tube extending in and spaced inwardly of said inner combustion chamber wall, said inner tube having a upper fuel inlet for receiving fuel and for depositing fuel at a lower end of said combustion chamber, said tube and said inner combustion chamber wall defining an annular air inlet chamber having an open upper end communicating with an exterior of said furnace, and an open lower end communicating with said combustion chamber, said combustion chamber having an open lower end, said furnace including an ash pas covering the open lower end of said combustion chamber;

means defining a hot air plenum connected to said furnace;

water circulation means connected to said water jacket extending into a lower portion of said plenum for circulating heated water from said jacket to said plenum and then back to said jacket, to heat air in the lower portion of said plenum;

at least one exhaust conduit connected to said exhaust chamber and extending through an upper portion of said plenum for passing hot exhaust gases from said exhaust chamber to heat air in the upper portion of said plenum; and means for circulating heating air through said plenum.

2. A heating unit according to claim 1, wherein said water circulation means comprises a water tank connected to said plenum, at least one upper water pipe connected between an upper end of said jacket and an upper end of said water tank and extending through said plenum, and at least one lower water pipe connected between a lower end of said water tank and a lower end of said jacket extending through said plenum.

3. A heating unit according to claim 2, including a smoke box positioned above said water tank and connected to said exhaust conduit for receiving exhaust gases from said exhaust conduit, and a stack connected to said smoke box.

4. A heating unit according to claim 3, wherein said means for circulating heating air comprises at least one inlet for air connected to a lower end of said plenum and at least one outlet for air connected to an upper end of said plenum.

5. A heating unit according to claim 1, including lifting means engaged under said ash pan for lifting said ash pan into engagement with a lower end of said water jacket for closing the lower end of said combustion chamber.

6. A heating unit according to claim 1, wherein said water circulation means comprises at least one tube having an inlet connected to an upper end of said water jacket and an outlet connected to a lower end of said water jacket, said tube extending in the lower portion of said plenum.

7. A heating unit according to claim 6, including a plurality of fins connected to said tube.

8. A heating unit according to claim 7, including a smoke box connected to said plenum, said at least one exhaust conduit having an outlet connected to said smoke box, and a stack connected to said smoke box for discharging exhaust from said smoke box.

9. A heating unit comprising:

a furnace having a combustion chamber for burning solid fuel, a water jacket around said combustion chamber for receiving water to be heated by the burning of solid fuel in the combustion chamber, and an exhaust chamber at an upper outlet end of said combustion chamber, for receiving hot exhaust gases from said combustion chamber, said furnace comprising an outer wall surrounding said water jacket, an inner jacket wall connected to said outer wall and defining said water jacket with said outer wall, an inner combustion chamber wall spaced inwardly from said inner jacket wall and defining said combustion chamber which is annular and around said inner walls, and a feed tube extending in and spaced inwardly of said inner combustion chamber wall, said inner tube having a upper fuel inlet for receiving fuel and for depositing fuel at a lower end of said combustion chamber, said tube and said inner combustion chamber wall defining an annular air inlet chamber having an open upper end communicating with an exterior of said furnace, and an open lower end communicating with said combustion chamber, means defining a hot air plenum connected to said furnace;

water circulation means connected to said water jacket extending into a lower portion of said plenum for circulating heated water from said jacket to said plenum and then back to said jacket, to heat air in the lower portion of said plenum;

at least one exhaust conduit connected to said exhaust chamber and extending through an upper portion of said plenum for passing hot exhaust gases from said exhaust chamber to heat air in the upper portion of said plenum;

means for circulating heating air through said plenum; and a heat sensitive hinge connected to said fuel inlet and a lid connected to said hinge, said hinge dropping said lid to close said fuel inlet when said hinge is subjected to a selected elevated temperature.

10. A heating unit comprising:

a furnace having a combustion chamber for burning solid fuel, a water jacket around said combustion chamber for receiving water to be heated by the burning of solid fuel in the combustion chamber, and an exhaust chamber at an upper outlet end of said combustion chamber, for receiving hot exhaust gases from said combustion chamber, means defining a hot air plenum connected to said furnace;

water circulation means connected to said water jacket extending into a lower portion of said plenum for circulating heated water from said jacket to said plenum and then back to said jacket, to heat air in the lower portion of said plenum;

at least one exhaust conduit connected to said exhaust chamber and extending through an upper portion of said plenum for passing hot exhaust gases from said exhaust chamber to heat air in the upper portion of said plenum;

means for circulating heating air through said plenum;

said water circulation means comprising a water storage tank having an inlet connected to an upper end of said water jacket and an outlet connected to a lower end of said water jacket, water circulating between said water jacket and said tank by natural thermal circulation, said tank being positioned within said plenum.

11. A heating unit according to claim 10, including a smoke box connected to said plenum, said at least one exhaust conduit being connected to said smoke box for discharging exhaust gases from said exhaust chamber to said smoke box, and a stack connected to said smoke box for discharging exhaust gases from said smoke box.

12. A heating unit comprising:

a water jacket having an inner wall and an outer walls paced outwardly from said inner wall and defining a water space therebetween, said inner wall being upwardly and downwardly open for receiving combustion air and solid fuel;

means defining an exhaust air chamber around an upper portion of said inner wall;

an ash pan defining a crucible and lower combustion space across said water jacket, the lower end of said inner wall being spaced above said ash pan; and a plurality of fire tubes extending substantially vertically in said water jacket and spaced around said inner wall, said fire tubes each having a lower end communicating with said lower combustion space and an upper end communicating with said exhaust air chamber, so that fuel and combustion air feed downwardly through said inner wall is burned in the lower combustion space to generate exhaust gases which move upwardly through said fire tubes into said exhaust air chamber.

13. A heating unit according to claim 12, including a polygonal fuel feed tube extending in said inner wall and defining an air inlet with said inner wall, communicating with said lower combustion chamber.

14. A heating unit according to claim 12, including a fuel-feed tube extending in said inner wall and defining an air inlet around said inner wall, communicating with said lower combustion chamber, said fuel-feed tube being upwardly and downwardly open for receiving fuel from its upper opening and discharging fuel into the lower combustion space through its lower opening.

15. A heating unit according to claim 14, wherein said fuel-feed tube is polygonal.

* * * * *